US007900617B1

(12) United States Patent
Kersh

(10) Patent No.: US 7,900,617 B1
(45) Date of Patent: Mar. 8, 2011

(54) LAUNCHER FOR A FLYING DISC

(76) Inventor: Lee A. Kersh, Eugene, OR (US)

( * ) Notice: Subject to any disclaimer, the term of this patent is extended or adjusted under 35 U.S.C. 154(b) by 615 days.

(21) Appl. No.: 11/855,089

(22) Filed: Sep. 13, 2007

(51) Int. Cl.
*F41B 5/00* (2006.01)

(52) U.S. Cl. ..... 124/5

(58) Field of Classification Search ..... 124/5
See application file for complete search history.

(56) References Cited

U.S. PATENT DOCUMENTS

| | | | | |
|---|---|---|---|---|
| 1,700,880 | A | 2/1929 | Camp | |
| 2,124,738 | A | 7/1938 | Johnsen | |
| 3,537,438 | A | 11/1970 | Reed | |
| 3,901,208 | A | 8/1975 | Laporte et al. | |
| 4,222,361 | A | 9/1980 | Jackson et al. | |
| 4,233,952 | A * | 11/1980 | Perkins | 124/5 |
| 4,347,828 | A * | 9/1982 | Bridgeman | 124/5 |
| 4,548,413 | A * | 10/1985 | David | 473/173 |
| 4,677,961 | A * | 7/1987 | Allison | 124/5 |
| 4,730,595 | A | 3/1988 | Glass et al. | |
| 4,984,556 | A | 1/1991 | Glass et al. | |
| 5,181,500 | A | 1/1993 | Chamberland | |
| D346,183 | S | 4/1994 | Crane | |
| 7,032,583 | B1 * | 4/2006 | Hall | 124/5 |

* cited by examiner

*Primary Examiner* — John Ricci
(74) *Attorney, Agent, or Firm* — David S. Alavi

(57) ABSTRACT

An apparatus for launching a flying disc comprises launching and handle members connected to permit relative angular motion, a disc gripper connected to the launching member, and a release mechanism coupled to the disc gripper to (i) enable it to hold the disc with the launching and handle members forming an angle less than a release angle and (ii) cause the disc gripper to release automatically the held disc as the launching and handle members move to the release angle. Launching the disc comprises: arranging the launching and handle members to form an angle less than the release angle; loading the disc into the disc gripper; engaging the release mechanism to engage the disc gripper to hold the disc; and grasping the handle member and swinging the launching apparatus to cause the launching and handle members to move to the release angle and to cause automatically the disc gripper to release the disc, thereby launching the disc.

22 Claims, 12 Drawing Sheets

12
12
12
900
900
900
A
R
14
14
14
16
16
16
18
18
18

14b
14a
14c
120
14
116
118
114
112

14b
14a
14c
120
14
116
124
118
114
112
124

14b
14a
120
14
124
114
112
124

LAUNCHER FOR A FLYING DISC

BACKGROUND

The field of the present invention relates to flying discs. In particular, apparatus and methods are disclosed herein for launching a flying disc.

A wide variety of launchers for disc-shaped objects have been developed over the years. Some of these are disclosed in:

U.S. Pat. No. 1,700,880 entitled "Target trap" issued Feb. 5, 1929 to Camp;

U.S. Pat. No. 2,124,738 entitled "Hand trap" issued Jul. 26, 1938 to Johnsen;

U.S. Pat. No. 3,537,438 entitled "Hand-operated target projecting device" issued Nov. 3, 1970 to Reed;

U.S. Pat. No. 3,901,208 entitled "Manual target throwing device" issued Aug. 26, 1975 to Laporte et al;

U.S. Pat. No. 4,222,361 entitled "Hand held disk launcher" issued Sep. 16, 1980 to Jackson et al;

U.S. Pat. No. 4,730,595 entitled "Disc launcher" issued Mar. 15, 1988 to Glass et al;

U.S. Pat. No. 4,984,556 entitled "Disk launcher" issued Jan. 15, 1991 to Glass et al;

U.S. Pat. No. 5,181,500 entitled "Pincers for throwing and catching a flying disc" issued Jan. 26, 1993 to Chamberland; and U.S. Pat. No. Des. 346,183 entitled "Combined toy disk and launcher" issued Apr. 19, 1994 to Crane.

SUMMARY

An apparatus for launching a flying disc comprises an elongated handle member, an elongated launching member, a disc gripper, and a release mechanism. The launching member is connected at its proximal end to the distal end of the handle member so as to permit relative angular motion of the launching member and the handle member. The disc gripper is connected to the launching member at its distal end. The release mechanism is operatively coupled to the disc gripper and arranged so as to (i) enable the disc gripper to hold the flying disc with the launching and handle members forming an angle less than a release angle and (ii) cause the disc gripper to release automatically the held flying disc as the launching and handle members move to the release angle from an angle less than the release angle.

A method for launching the flying disc comprises: (i) arranging the launching and handle members to form an angle less than the release angle; (ii) loading the flying disc into the disc gripper; (iii) engaging the release mechanism to engage the disc gripper to hold the flying disc; and (iv) grasping the proximal end of the handle member and swinging the launching apparatus to cause the launching and handle members to move to the release angle and to cause automatically the disc gripper to release the flying disc, thereby launching the flying disc.

Objects and advantages pertaining to launchers for and launching of a flying disc may become apparent upon referring to the exemplary embodiments illustrated in the drawings and disclosed in the following written description and/or claims.

The embodiments shown in the Figures are exemplary, and should not be construed as limiting the scope of the present disclosure and/or appended claims. It should be noted that the drawings depict an exemplary embodiment suitable for use by a right-handed user, however, it is intended that the present disclosure and claims shall encompass both right- and left-handed embodiments, as well as embodiments that can be used with either handedness.

DETAILED DESCRIPTION OF EMBODIMENTS

Figures 14A, 14B, 14C:
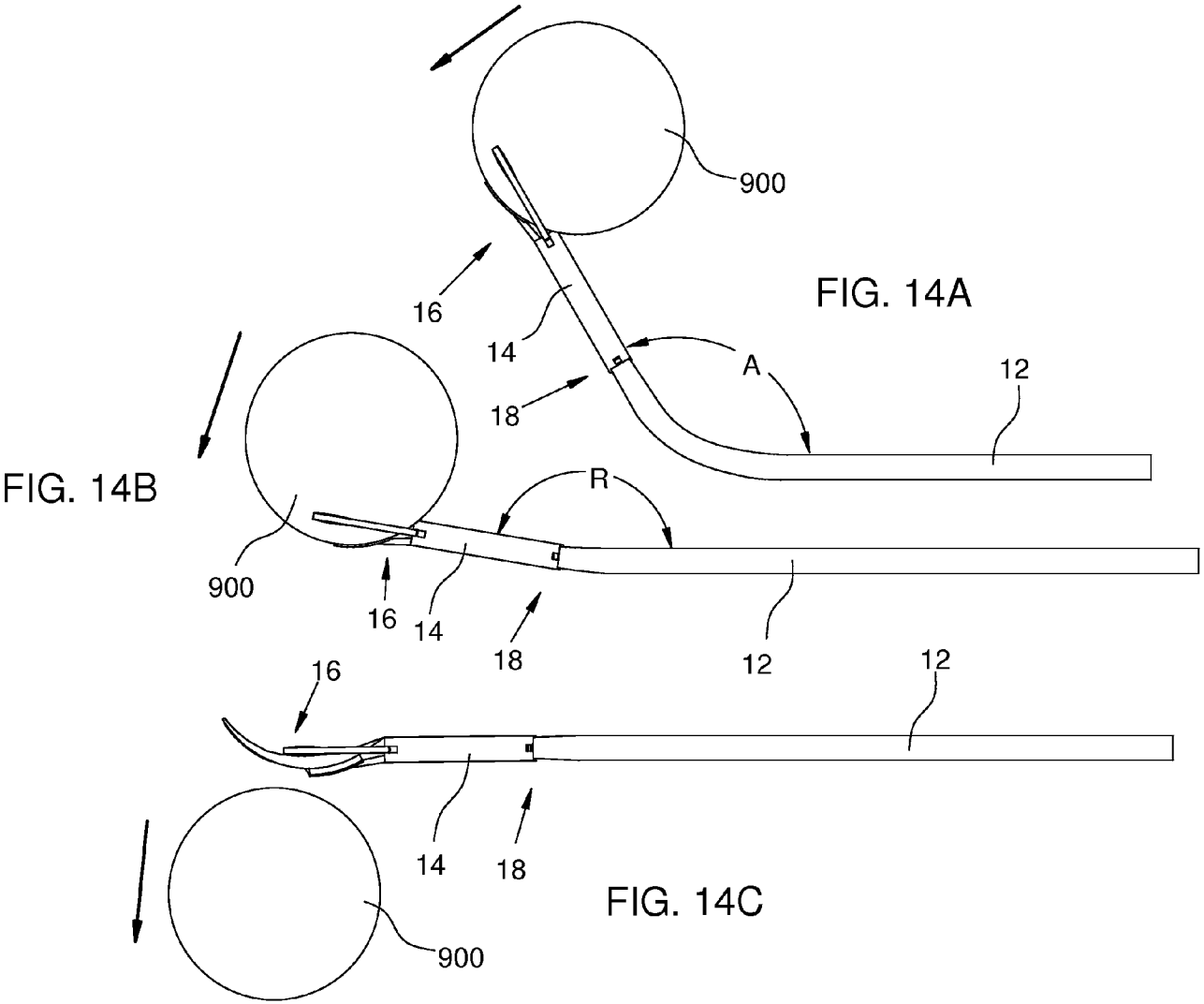
FIGS. 14A-14C are plan views of another exemplary disc launcher.

An exemplary embodiment of an apparatus for launching a flying disc is illustrated schematically in FIGS. 1A-1B, 2A-2B, 3A-3B, 4A-4B, and 5A-5B. In each pair of Figures, the "A" figure shows the disc launcher alone, while the "B" figure shows the disc launcher with a disc 900 in position to be gripped by the disc launcher (but not necessarily gripped). The disc launcher comprises an elongated handle member 12, an elongated launching member 14, a disc gripper 16, and a release mechanism 18. The launching member 14 is connected at its proximal end to the distal end of the handle member 12 so as to permit relative angular motion of the launching member and the handle member. Any suitable mechanical linkage can be employed for connecting the handle member 12 and launching member 14 that enable the relative angular motion, including but not limited to a clevis-and-pin joint (as in the exemplary embodiment), a hinge joint, a ball-and-socket joint, a disc-and-slot joint, or a universal joint. The clevis-and-pin joint of the exemplary embodiment comprises a disc-shaped rearward projection 14*a* of the launching member 14 positioned between a pair of opposed, spaced-apart disc-shaped forward projections 12*a* of the handle member 12 (FIGS. 7A-7C and 8A-8D). The handle member 12 and the launching member 14 can be connected to permit angular motion about multiple axes; typically, the handle member 12 and the launching member 14 are connected to permit angular motion about a single rotation axis, which would be oriented roughly perpendicularly relative to a plane of motion in which the disc launcher would be swung when used to launch a disc (as in the illustrated exemplary embodiment). The handle member 12 and launching member 14 can comprise metal, plastic, wood, composite, or any other material or material combination having suitable strength and stiffness. Alternatively, the handle member 12 and the launching member 14 can comprise a single elongated flexible resilient member, and bending of the resilient member can provide the relative angular motion (as in FIGS. 14A-14C). Such a flexible resilient member can comprise any material having a suitable combination of strength and flexibility.

Figure 1A:
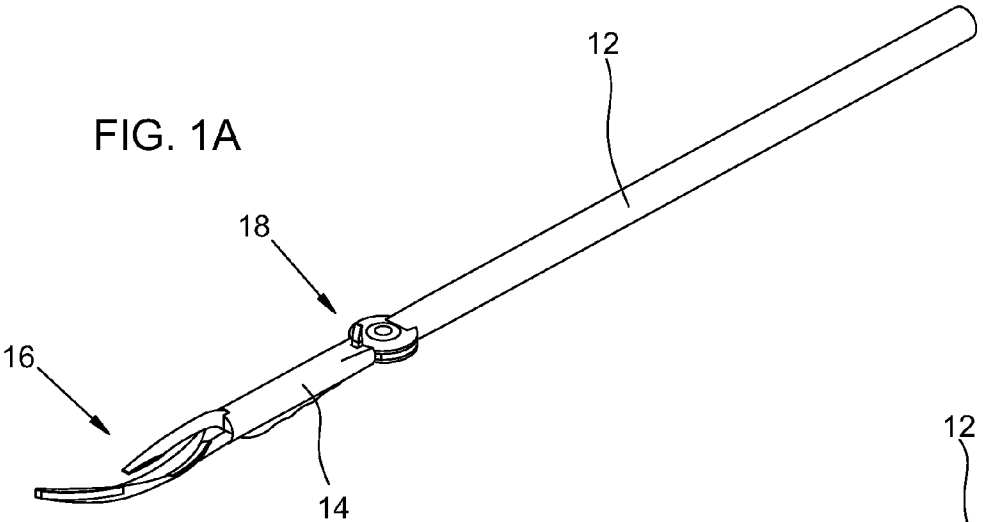
FIGS. 1A and 1B are perspective views of an exemplary disc launcher.
Figure 1B:
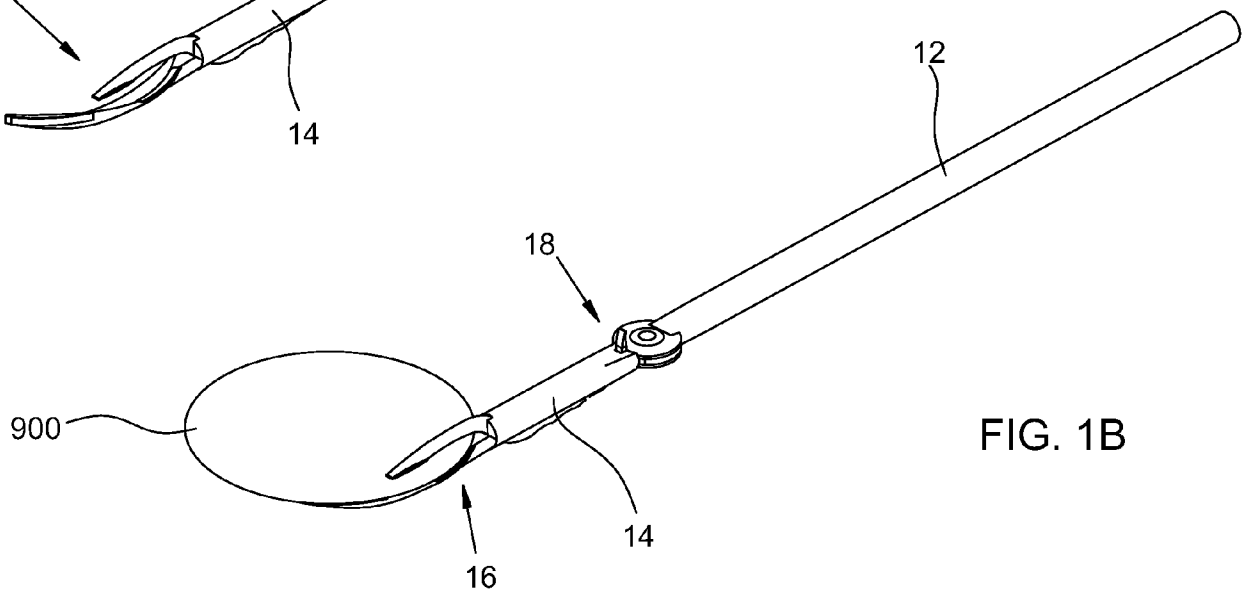
Figure 2A:
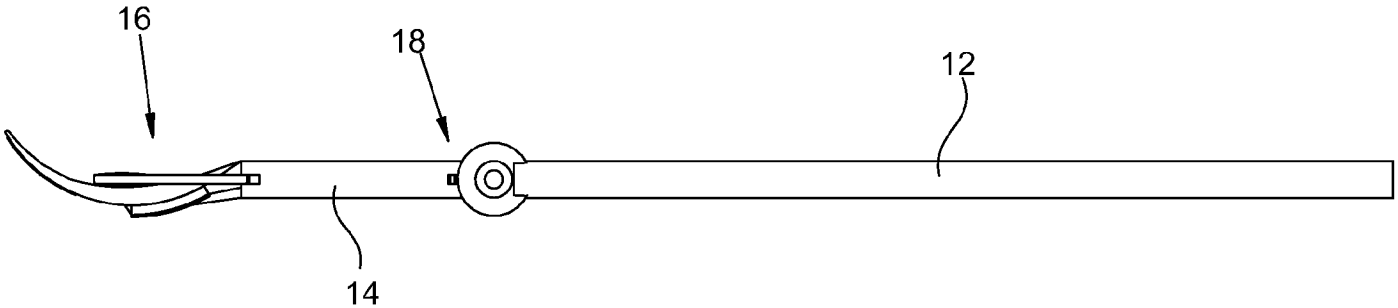
FIGS. 2A and 2B are plan views of an exemplary disc launcher.
Figure 2B:
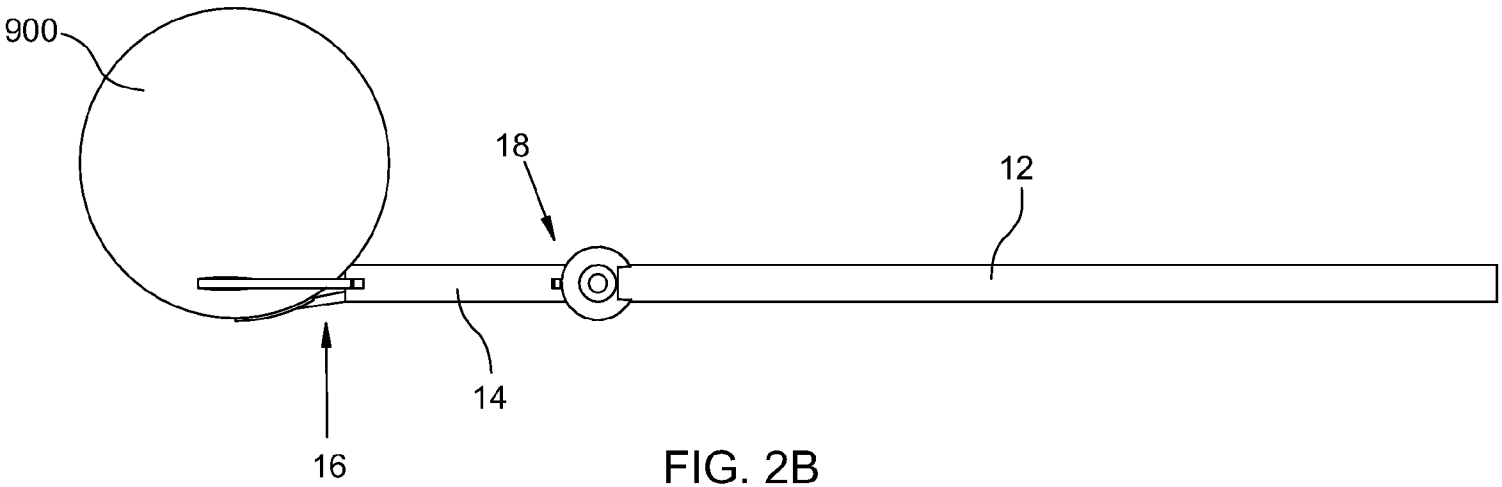
Figure 3A:
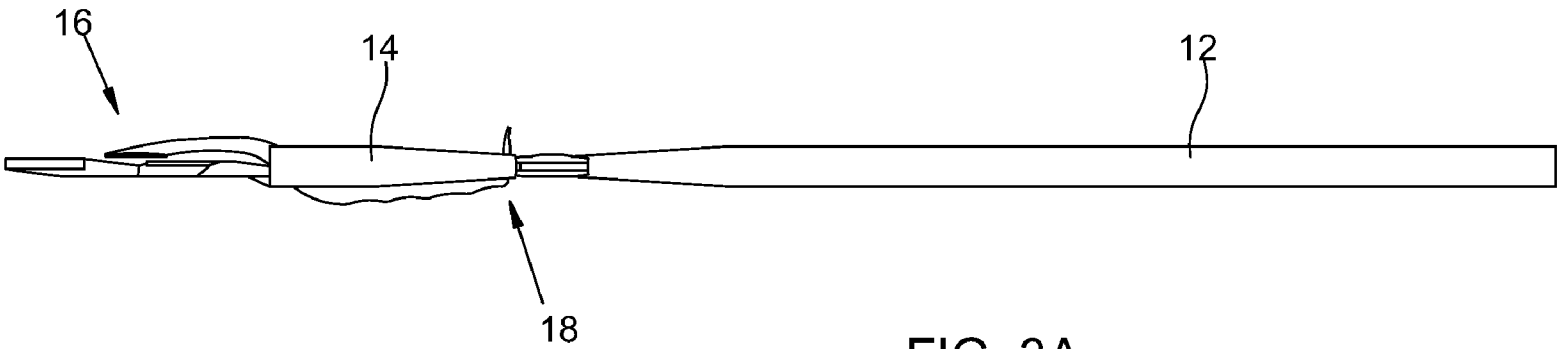
FIGS. 3A and 3B are elevation views of an exemplary disc launcher.
Figure 3B:
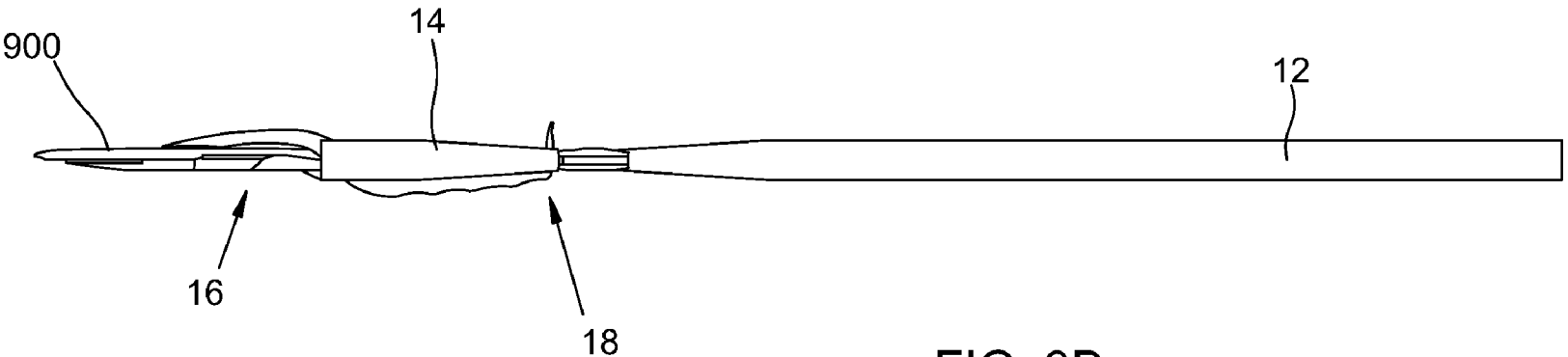
Figure 4A:
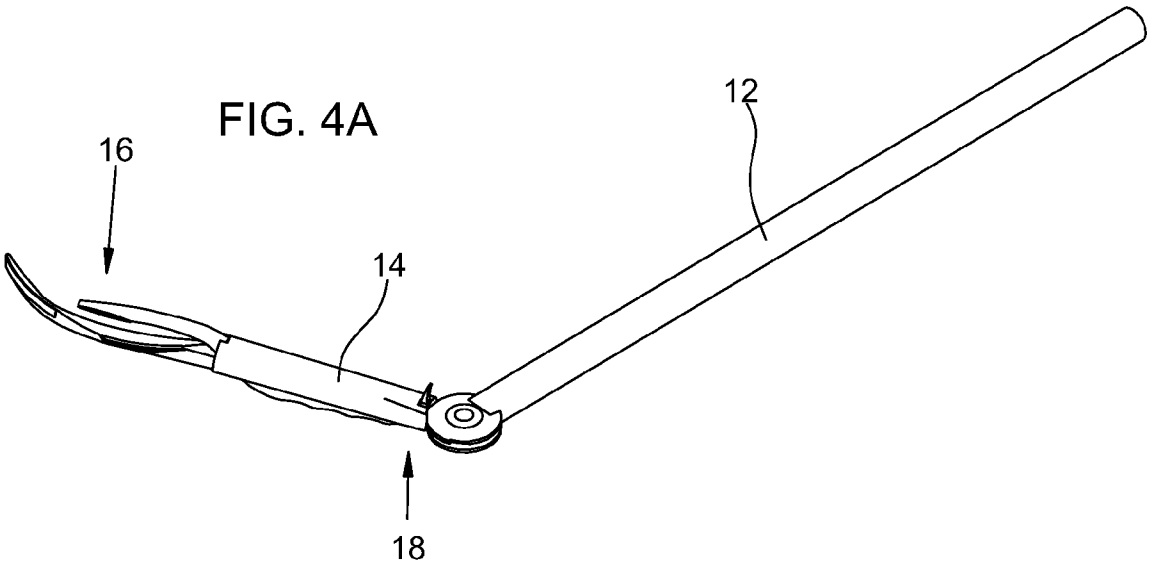
FIGS. 4A and 4B are perspective views of an exemplary disc launcher.
Figure 4B:
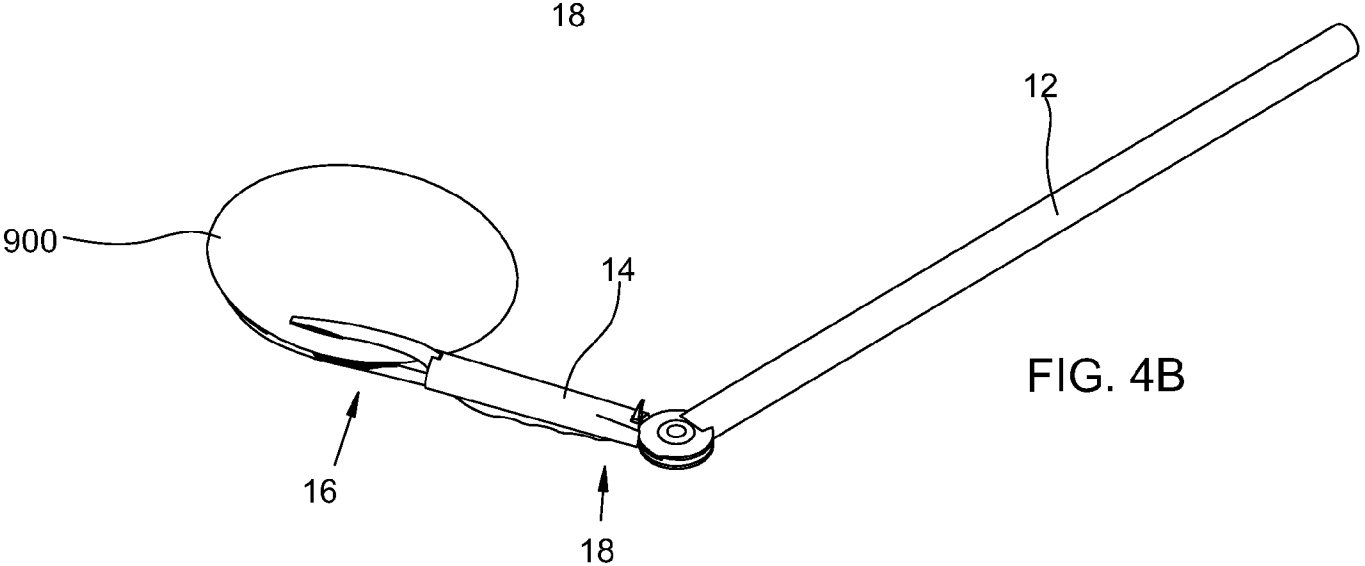
Figure 5A:
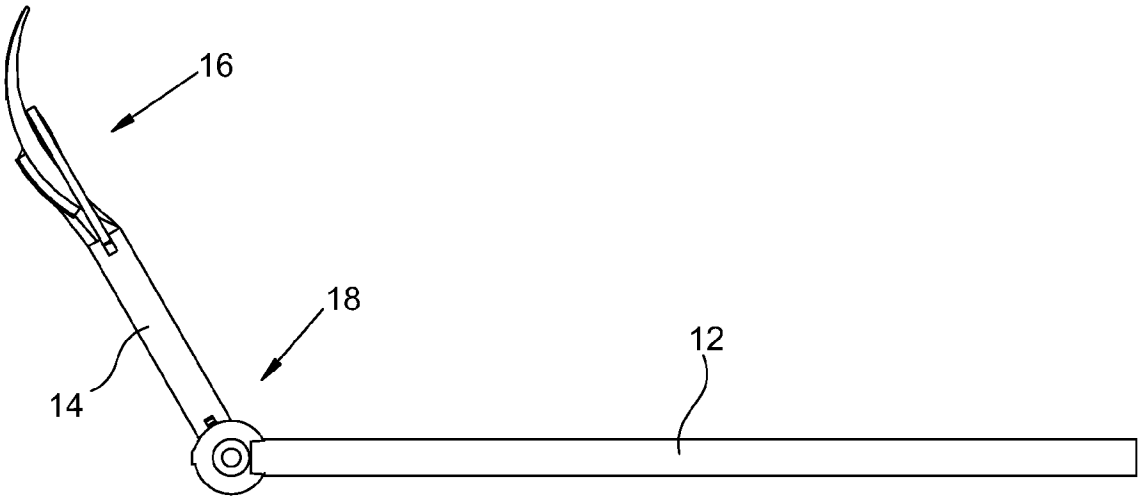
FIGS. 5A and 5B are plan views of an exemplary disc launcher.
Figure 5B:
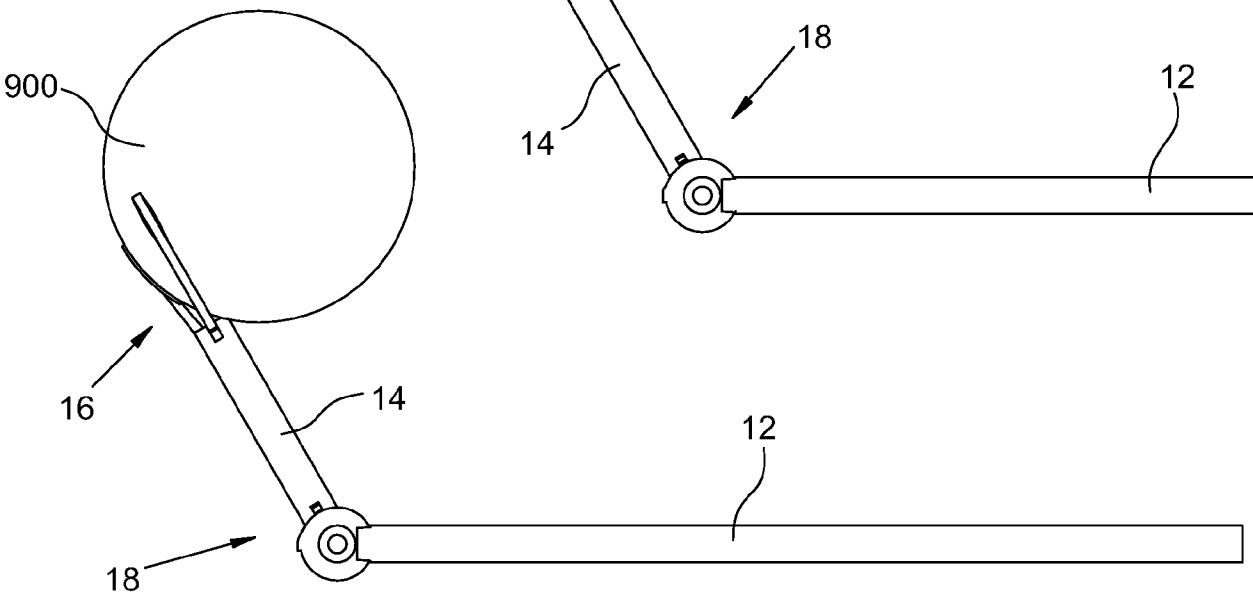
Figures 6A, 6B, 6C:
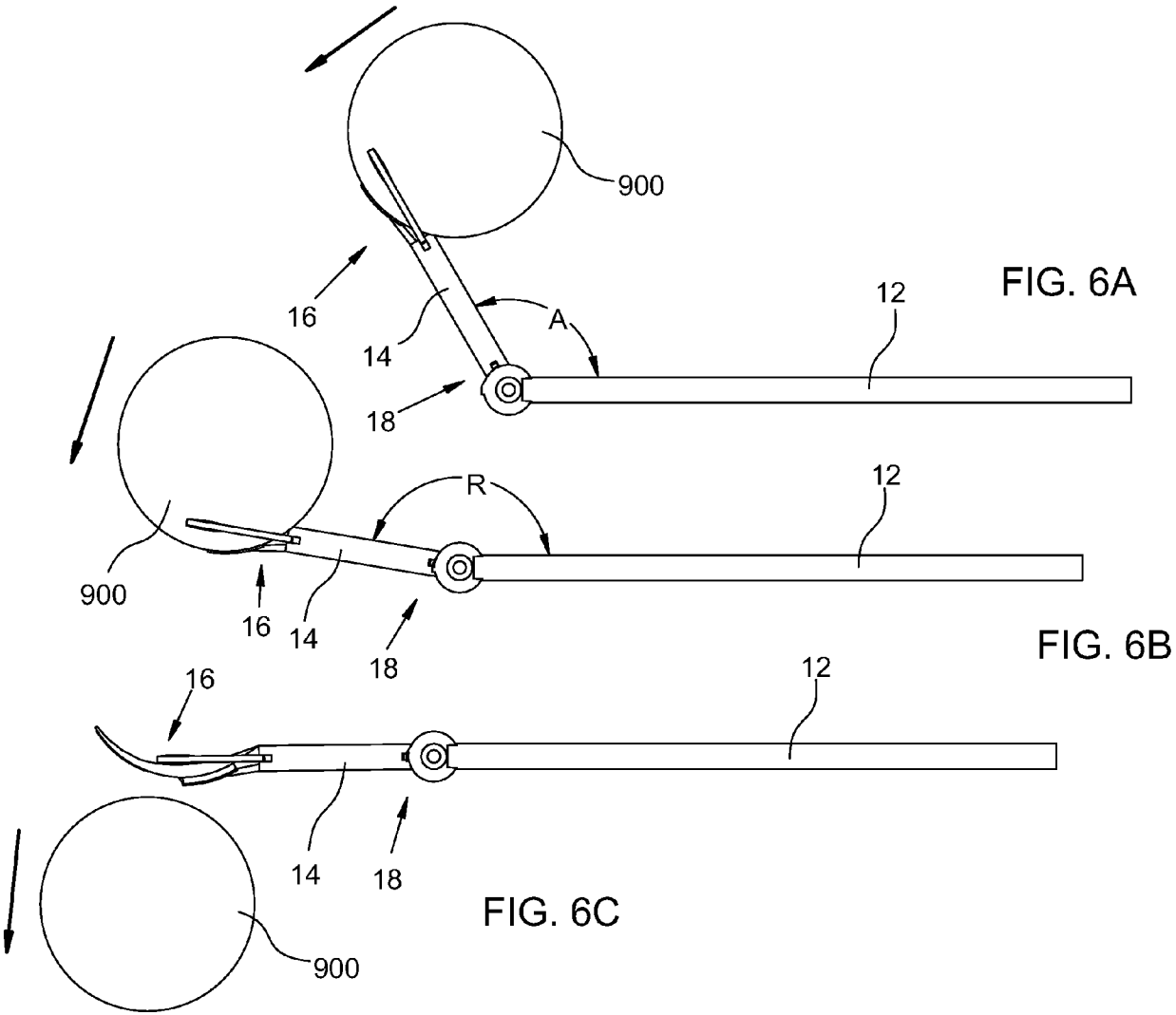
FIGS. 6A-6C are plan views of an exemplary disc launcher.
Figures 7A, 7B, 7C:
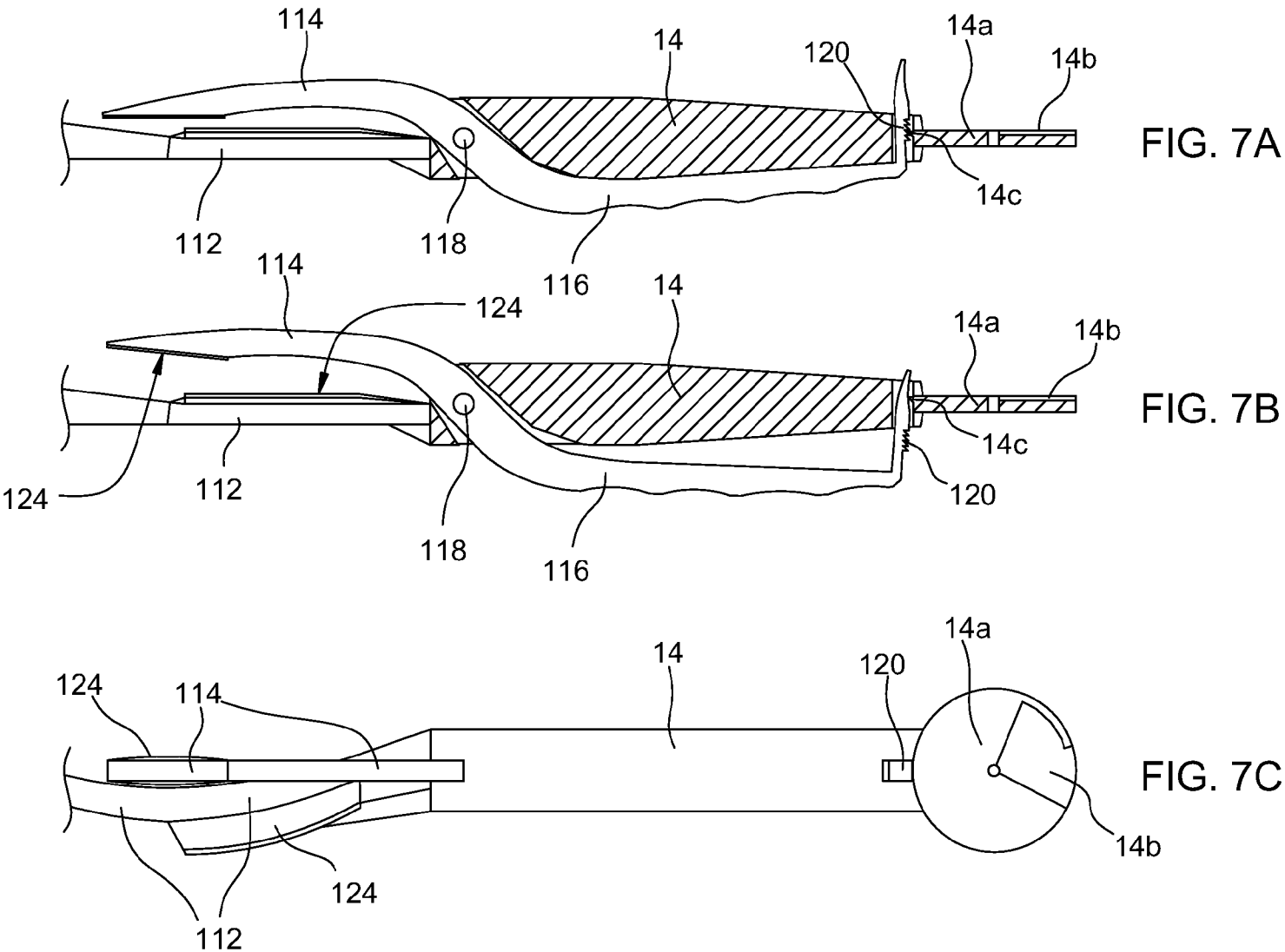
FIGS. 7A and 7B are longitudinal partial cross-sectional views of a launching member and a disc gripper of an exemplary disc launcher.
FIG. 7C is a plan view of the launching member and the disc gripper of the exemplary disc launcher.
Figure 8A:
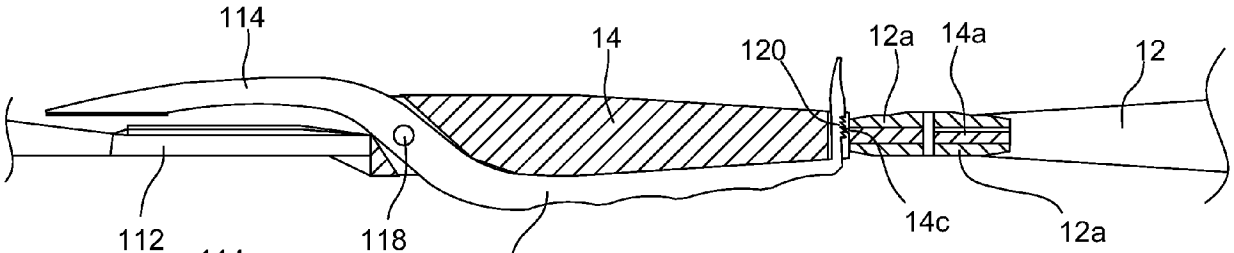
FIGS. 8A and 8B are longitudinal partial cross-sectional views of assembled launching and handle members and a disc gripper of an exemplary disc launcher.
Figure 8B:
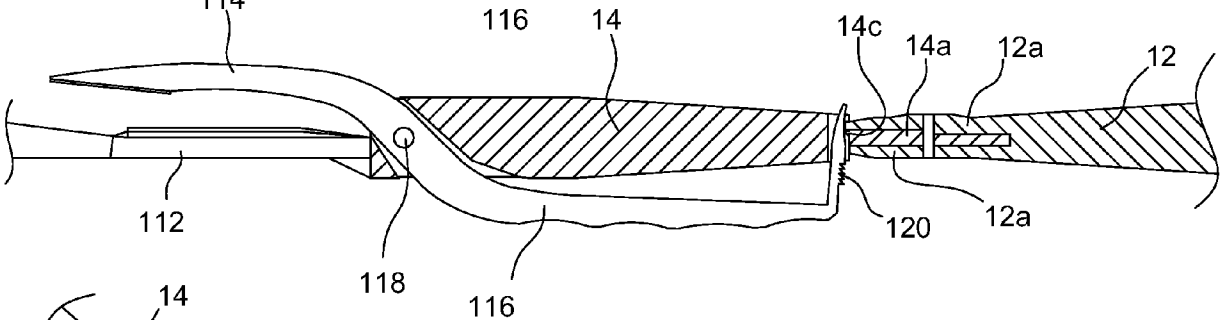
Figure 8C:
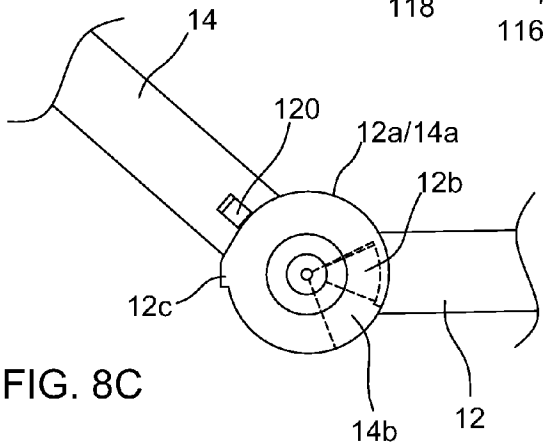
FIGS. 8C and 8D are plan views of the assembled launching and handle members of the exemplary disc launcher.
Figure 8D:
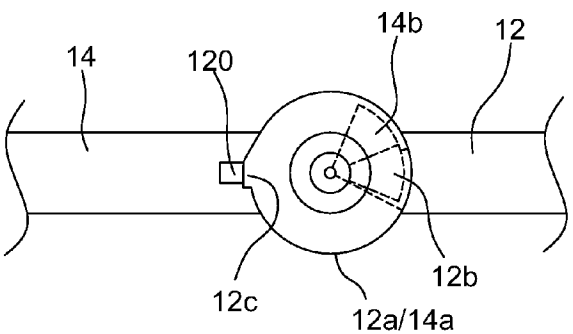

The disc gripper 16 is connected to the distal end of the launching member 14 and can be arranged in any suitable way for gripping the flying disc 900. As illustrated schematically in FIGS. 6A-6C, the release mechanism 18 is operatively coupled to the disc gripper 16 and arranged so as to (i) enable the disc gripper 16 to hold the flying disc 900 with the handle member 12 and the launching member 14 forming an angle (A) less than a release angle (R) and (ii) cause the disc gripper 16 to release automatically the held flying disc 900 as the handle member 12 and the launching member 14 move to the release angle (R) from the angle (A) less than the release angle (R). The handle member 12, the launching member 14, and the disc gripper 16 are typically arranged to enable motion only about a single rotations axis and so that the rotation axis is substantially perpendicular to the held flying disc 900. Other suitable orientations of the held disc 900 relative to the rotation axis can be employed. The automatic release of the disc upon the handle and launching members reaching the release angle ensures that the disc leaves the launcher at a consistent point in its trajectory when swung by a user, enhancing the ability of the user to accurately direct the launched disc in a desired direction.

In the exemplary embodiment, the disc gripper 16 comprises a pair of opposed gripping members 112 and 114 arranged for gripping the flying disc 900 positioned between them (FIGS. 7A-7C and 8A-8B). At least one of the opposed gripping members (gripping member 114 in the exemplary embodiment) is pivotably connected to the launching member 14 so as to enable relative movement of the gripping members 112 and 114 away from and toward one another. As shown in the exemplary embodiment, the opposed gripping members 112 and 114 are arranged to hold the flying disc by engaging the disc's top and bottom surfaces, however, any suitable arrangement of the disc gripper 16 or gripping members 112 and 114 can be employed. The gripping members 112 and 114 can comprise metal, plastic, wood, composite, or any other material or material combination having suitable strength and stiffness. One or both gripping members can further include friction material or resilient material 124 positioned in any suitable way to make contact with the held disc 900 (indicated in FIGS. 7B and 7C). Suitable resilient materials can include but are not limited to natural or synthetic rubber, neoprene, vinyl, various plastics; any suitable friction material can be employed (e.g., sand-paper-like materials). One or both of the gripping members 112 and 114 can be curved to engage a portion of the disc's outer circumference in any suitable fashion. As shown in the exemplary embodiment, the gripping member 112 is curved so as to enable engagement with the inner circumferential surface of the lip on the underside of the flying disc 900 held between the opposed gripping members 112 and 114.

In the exemplary embodiment, the release mechanism 18 is operatively coupled to at least one of the opposed gripping members 112 or 114 so as to (i) bias the opposed gripping members 112 and 114 toward one another to hold the flying disc 900 between them with the handle member 12 and the launching member 14 forming an angle (A) less than the release angle (R) and (ii) release automatically the bias on the gripping members 112 and 114 thereby releasing the held flying disc 900 as the handle member 12 and the launching member 14 move to the release angle (R) from the angle (A) less than the release angle. The release mechanism 18 can be thus coupled in any suitable way. In the exemplary embodiment, the pivotably connected gripping member 114 comprises an elongated distal arm of a lever and is arranged for gripping the flying disc 900. The lever also comprises a proximal lever arm 116 arranged for engaging the release mechanism 18, and is pivotably connected to the launching member 14 at a pivot point 118 between the lever arms 114 and 116.

The proximal lever arm 116 of the exemplary embodiment includes a linear ratchet 120 arranged so as to (i) engage the release mechanism 18 to bias the gripping members 112 and 114 toward one another with the handle member 12 and the launching member 14 forming an angle (A) less than the release angle (R) and (ii) disengage automatically from the release mechanism 18 and release the bias on the gripping members 112 and 114 as the handle member 12 and the launching member 14 move to the release angle (R) from the angle (A) less than the release angle. In the exemplary embodiment, release mechanism 18 includes a flange 14*c* on the launching member 14 that is arranged so as to (i) engage the linear ratchet 120 with the handle member 12 and the launching member 14 forming an angle (A) less than the release angle (R) and (ii) disengage automatically from the linear ratchet 120 as the handle member 12 and the launching member 14 move to the release angle (R) from an angle (A) less than the release angle. In an alternative embodiment, such a flange could be positioned on handle member 12 instead (described further below). The proximal lever arm 116 can be arranged to engage or disengage from the release mechanism 18 in any other suitable manner.

Figure 9B:
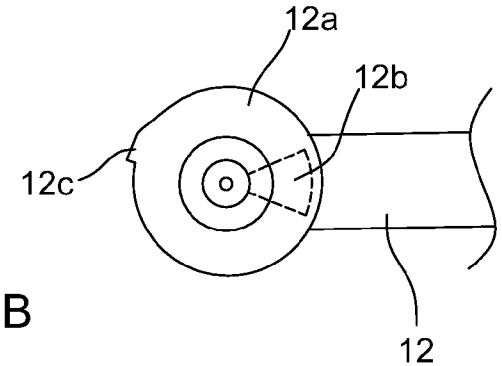
FIGS. 9A and 9B illustrate schematically adjustment of the release angle of an exemplary disc launcher.
Figure 9A:
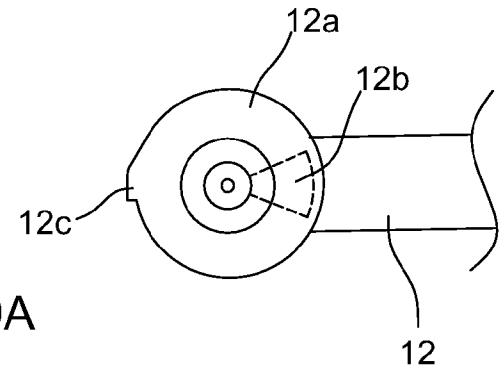

In the exemplary embodiment, one of the projections 12*a* can be arranged to include a cam portion 12*c* (FIGS. 8A-8D and 9A-9B). The cam portion 12*c* is positioned to allow engagement of the linear ratchet 120 and the flange 14*c* with the handle member 12 and the launching member 14 forming an angle (A) less than the release angle (R), thereby retaining the disc 900 held between gripping members 112 and 114. Upon the launching and handle members 12 and 14 reaching the release angle (R), the cam portion 12*c* forces disengagement of the linear ratchet 120 from the flange 14*c* to allow movement of the lever arms 114 and 116, thereby releasing the disc 900. The linear ratchet 120, lever arm 116, or lever arm 114 typically should be sufficiently resilient to maintain engagement of the linear ratchet 120 and the flange 14*c* when gripping the disc 900, while enabling the cam portion 12*c* to force disengagement of the linear ratchet 120 from the flange 14*c*. The release angle (R) is determined by the location of the cam portion 12*c* on projection 12*a*. The release angle (R) can be a fixed parameter of the disc launcher, or can be made adjustable, e.g., by arranging the cam portion 12*c* to be fixed at various angular positions on projection 12*a* (FIGS. 9A-9B). Any suitable arrangement for enabling adjustment of the release angle can be employed.

Figure 13A:
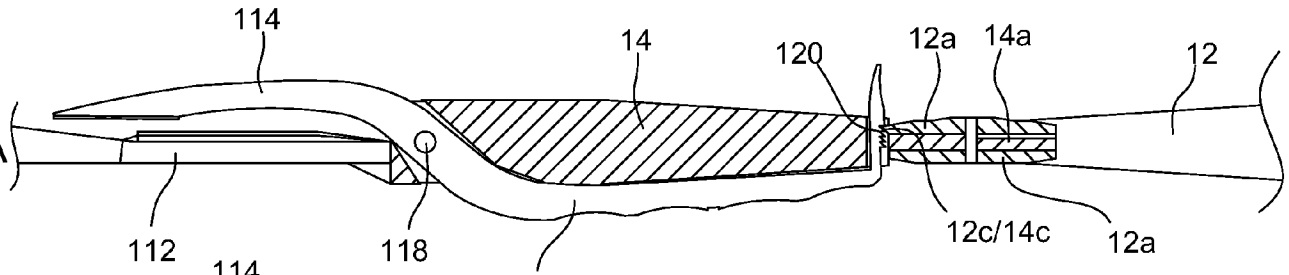
FIGS. 13A and 13B are longitudinal partial cross-sectional views of assembled launching and handle members and an exemplary disc gripper of a disc launcher.
Figure 13B:
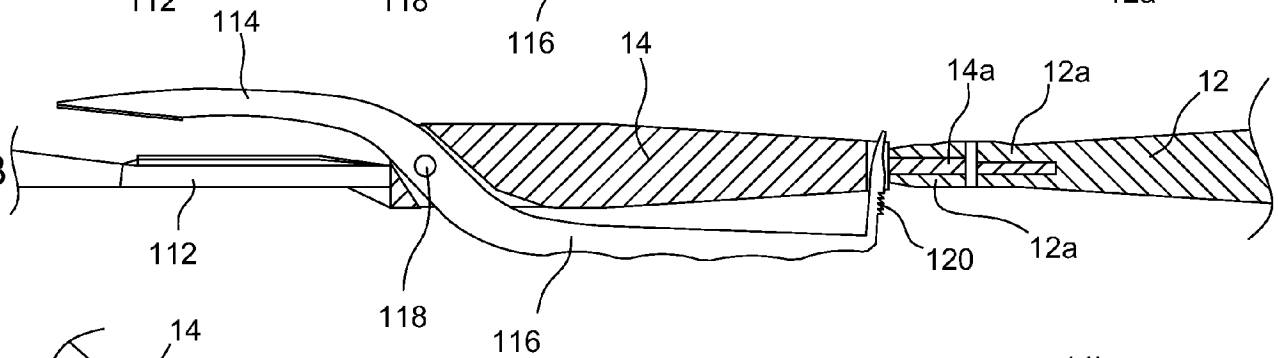
Figure 13D:
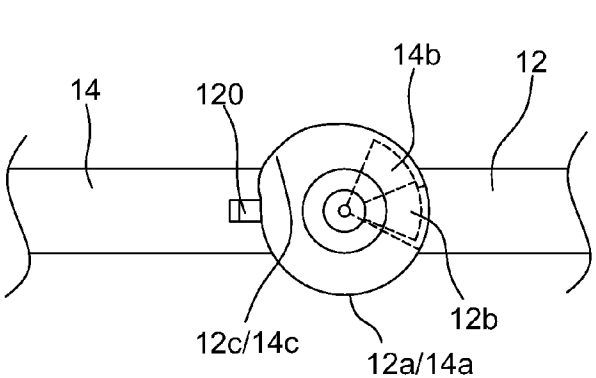
FIGS. 13C and 13D are plan views of the assembled launching and handle members of the exemplary disc launcher.
Figure 13C:
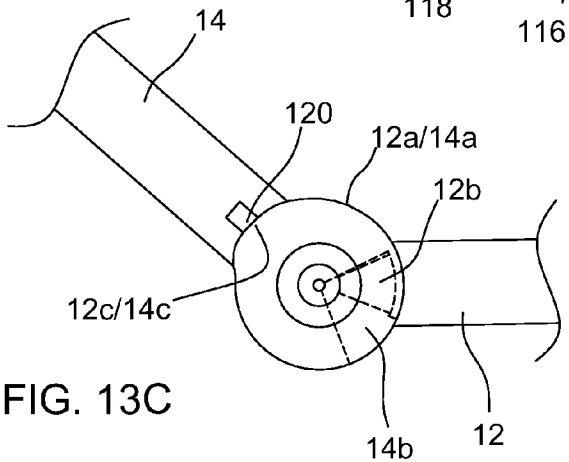

In an alternative embodiment (FIGS. 13A-13D), the flange 14*c* can be positioned on projection 12*a* of the launching member 12 and arranged so that the flange engages the linear ratchet 120 with the handle member 12 and the launching member 14 forming an angle (A) less than the release angle (R), as in FIGS. 13A and 13C, but disengages from the linear ratchet 120 upon reaching the release angle (R), as in FIGS. 13B and 13D. For example, the cam portion 12*c* can act as a portion of the flange 14*c*. The radius of the flange 14*c* can be made to vary substantially continuously over a cam portion 12*c*, so that the edge of the flange 14*c* engages the linear ratchet 120 at the angle (A), but does not engage the linear ratchet 120 at the release angle (R). Alternatively, the radius of the flange 14*c* can vary discontinuously (not shown). For example, the flange 14*c* can have a substantially constant radius that enables engagement of the linear ratchet 120, but can also be provided with a radial slot or notch that aligns with the linear ratchet 120 at the release angle (R) to allow disengagement of the linear ratchet from the flange 14*c*. Any other suitable arrangement of the release mechanism for engaging or disengaging from the linear ratchet can be employed.

The angle (A) formed between the handle member 12 and the launching member 14 typically has some minimum angle imposed by the nature of the mechanical joint connecting them. It may be possible to arrange the handle member 12 and launching member 14 so that the minimum angle is anywhere from 0° to 180°, but the minimum angle is typically greater than about 60°, more typically greater than about 90°, and most typically greater than or equal to about 120°. The angle (A) referred to in the present disclosure will typically be greater than the minimum angle and only extend beyond the release angle (R) by a few degrees (perhaps as much as about 10°). The release angle (R) is typically less than or equal to about 180°, and can range between about 150° and about 180° (note that angles greater than 180° indicate that the handle and launching members have moved through and beyond a parallel arrangement). The handle member 12 and the launching member 14 can be arranged so as to limit the relative angular motion to less than a maximum angle, which is at least as large as the release angle (R). In some instances the maximum angle is about equal to the release angle (R); in other instances the maximum angle is greater than the release angle (R).

In the exemplary embodiment, the handle member 12 and the launching member 14 are arranged so as to limit their relative rotation between the minimum and maximum angles. A wedge-shaped depression 14*b* on the rearward projection 14*a* of launching member 14 receives a wedge-shaped protrusion 12*b* on one of the opposed surfaces of forward projections 12*a* of handle member 12 (FIGS. 7A-7C and 8A-8D). The angular positions and subtended angles of protrusion 12*b* and depression 14*b* determine the maximum and minimum angles for relative motion of the launching and handle members 14 and 12. Any other suitable mechanical arrangement can be employed for limiting the angular motion.

Figure 12:
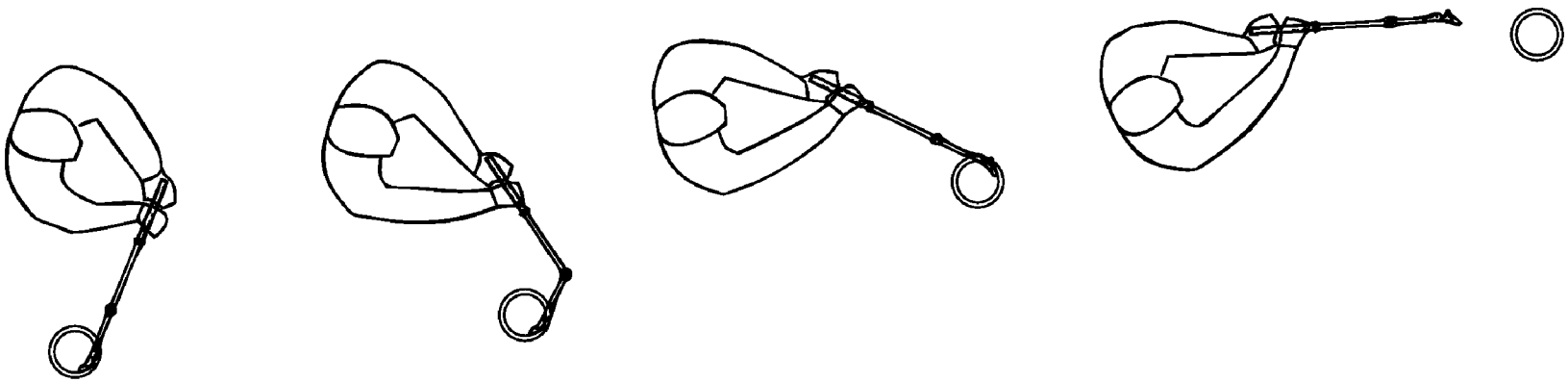
FIG. 12 illustrates schematically a user launching a disc with an exemplary disc launcher.

A method for launching the flying disc comprises: (i) arranging the handle member 12 and the launching member 14 to form an angle (A) less than the release angle (R); (ii) loading the flying disc 900 into the disc gripper 16; (iii) engaging the release mechanism 18 to engage the disc gripper 16 to hold the flying disc 900; and (iv) grasping the proximal end of the handle member 12 (with one hand or with both hands, as desired) and swinging the launching apparatus to cause the handle member 12 and the launching member 14 to move to the release angle (R) and to cause automatically the disc gripper 16 to release the flying disc 900, thereby launching the flying disc 900. Typically, the plane of the swing, the plane of the disc, and the plane in which handle member 12 and launching member 14 rotate relative to one another are approximately parallel to one another to result in proper flight of the flying disc. Other arrangements can be employed if suitable or desired. A typical swing is illustrated schematically in FIG. 12.

Figure 10:
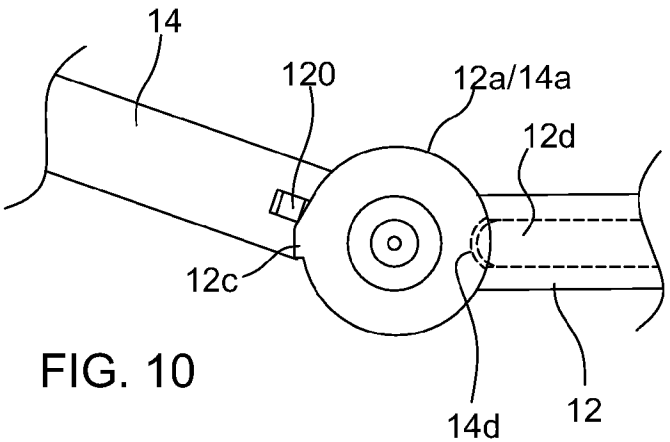
FIG. 10 illustrates schematically a detent mechanism for an exemplary disc launcher.

Use of the disc launcher will typically include a backswing after the disc is loaded into the disc gripper. During the backswing, inertia will tend to move the launching member toward or beyond the release angle, causing the disc to be released prematurely. An variety of mechanisms or arrangement can be employed to prevent (or reduce the likelihood of) such a premature release. In the exemplary embodiment illustrated schematically in FIG. 10, a spring-loaded detent mechanism (depression 14*d* in the edge of projection 14*a* of launching member 14 and a rounded, spring-loaded piston 12*d* reciprocally moveable within handle member 12) can be employed to retain the launching member at a fixed loading position only a few degrees less than the release angle. Tension or friction on the detent mechanism can be made sufficiently large to retard motion of the launching member so as to substantially prevent movement of the launching member toward the release angle during a typical backswing, but sufficiently small so as to allow movement away from the release angle during the early portion of the forward swing and then toward and to the release angle during the latter portion of the forward swing (to release the disc). Alternatively, a manually operated bolt or pin could be employed to prevent angular motion of the launching member during the backswing and allow such motion during the forward swing, or any other suitable manual or automatic mechanism can be employed.

Figure 11:
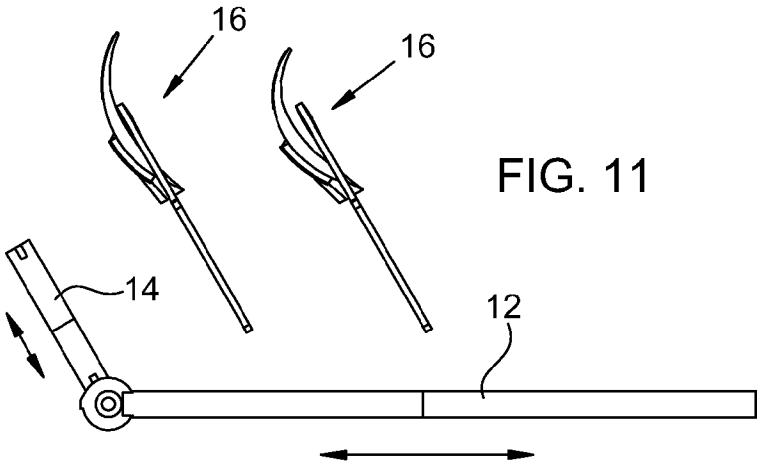
FIG. 11 illustrates schematically length adjustment of the handle and launching members of an exemplary disc launcher and alternate disc grippers.

The direction of disc flight relative to the swing, the distance traveled by the launched disc, and the character of the disc's flight each depend on the dimensions and arrangement of the disc launcher. Any desired lengths can be chosen for the handle and launching members. The handle member is typically less than about 3 feet long, and often between about 2 feet long and about 3 feet long; the launching member is typically less than about 2 feet long, and often between about 1 foot long and about 2 feet long. A longer handle member 12 can result in longer disc flight, but too long of a handle member impedes swinging of the launcher due to increased weight and air resistance. The relative lengths of the launching member 14 and handle member 12 affect the amount of spin imparted onto the launched disc, which can be optimized empirically for each type of disc, for each user, or for desired disc flight characteristics. Both handle member 12 and launching member 14 can be constructed with telescoping or interchangeable shafts or barrels, to enable adjustments of their lengths to achieve such optimization (FIG. 11). Likewise, the precise shape, size, or arrangement of the disc gripper 16 will affect the distance achieved of disc flight characteristics. Different disc grippers 16 can be provided and interchanged on the end of launching member 14, to accommodate different users or different discs (FIG. 11), including discs approved by the Professional Disc Golf Association (PDGA). As already described above, the release angle or the maximum or minimum angles can be adjusted to the swing characteristics for a specific user. Most of the preceding adjustments are typically made empirically, based on observed flight or performance characteristics of launched discs.

It is intended that equivalents of the disclosed exemplary embodiments and methods shall fall within the scope of the present disclosure and/or appended claims. It is intended that the disclosed exemplary embodiments and methods, and equivalents thereof, may be modified while remaining within the scope of the present disclosure or appended claims.

For purposes of the present disclosure and appended claims, the conjunction "or" is to be construed inclusively (e.g., "a dog or a cat" would be interpreted as "a dog, or a cat, or both"; e.g., "a dog, a cat, or a mouse" or "a dog or a cat or a mouse" would be interpreted as "a dog, or a cat, or a mouse, or any two, or all three"), unless: (i) it is explicitly stated otherwise, e.g., by use of "either . . . or", "only one of . . . ", or similar language; or (ii) two or more of the listed alternatives are mutually exclusive within the particular context, in which case "or" would encompass only those combinations involving non-mutually-exclusive alternatives. For purposes of the present disclosure or appended claims, the words "comprising", "including", "having", and variants thereof shall be construed as open ended terminology, with the same meaning as if the phrase "at least" were appended after each instance thereof.

What is claimed is:

1. An apparatus for launching a flying disc, the apparatus comprising:

an elongated handle member;

an elongated launching member connected at a proximal end thereof to a distal end of the handle member so as to permit relative angular motion of the launching member and the handle member;

a disc gripper connected to the launching member at a distal end of the launching member; and a release mechanism operatively coupled to the disc gripper and arranged so as to (i) enable the disc gripper to hold the flying disc with the launching and handle members forming an angle less than a release angle and (ii) cause the disc gripper to release automatically the held flying disc as the launching and handle members move to the release angle from an angle less than the release angle, wherein:

the disc gripper comprises a pair of opposed gripping members arranged for gripping the flying disc positioned between them;

at least one of the opposed gripping members is pivotably connected to the launching member so as to enable relative movement of the gripping members away from and toward one another; and the release mechanism is operatively coupled to at least one of the opposed gripping members so as to (i) bias the opposed gripping members toward one another to hold the flying disc between them with the launching and handle members forming an angle less than the release angle and (ii) release automatically the bias on the gripping members to thereby release the held flying disc as the launching and handle members move to the release angle from an angle less than the release angle.

2. The apparatus of claim 1 wherein one of the opposed gripping members is curved so as to enable engagement with the inner circumferential surface of the lip of the flying disc held between the opposed gripping members.

3. The apparatus of claim 1 wherein each of the gripping members includes a resilient material or a friction material positioned so as to make contact with the held flying disc.

4. The apparatus of claim 1 wherein the launching member and the handle member are arranged to enable the relative angular motion about only a single rotation axis, and the gripping members are arranged so that the rotation axis of the relative angular motion is substantially parallel to the axis of the held flying disc.

5. The apparatus of claim 1 wherein the pivotably connected gripping member comprises an elongated lever having a distal lever arm arranged for gripping the flying disc, having a proximal lever arm arranged for engaging the release mechanism, and being pivotably connected to the launching member at a pivot point between the lever arms.

6. The apparatus of claim 5 wherein the proximal lever arm includes a linear ratchet arranged so as to (i) engage the release mechanism to bias the gripping members toward one another with the launching and handle members forming an angle less than the release angle and (ii) disengage automatically from the release mechanism and release the bias on the gripping members as the launching and handle members move to the release angle from an angle less than the release angle.

7. The apparatus of claim 6 wherein the release mechanism comprises a flange on the launching member and a cam portion on the handle member, the flange being arranged so as to engage the linear ratchet, the cam portion being arranged so as to (i) enable engagement of the linear ratchet and the flange with the launching and handle members forming an angle less than the release angle and (ii) force automatic disengagement of the linear ratchet from the flange as the launching and handle members move to the release angle from an angle less than the release angle.

8. The apparatus of claim 1 wherein the launching and handle members are arranged so as to limit the relative angular motion between them to more than a minimum angle and to less than a maximum angle.

9. The apparatus of claim 1 wherein the release mechanism, the launching member, the handle member, or the disc gripper is arranged so as to enable adjustment of the release angle, adjustment of the length of the handle member, adjustment of the length of the launching member, or interchange of different disc grippers each adapted hold a different type of flying disc.

10. The apparatus of claim 1 further comprising a detent mechanism arranged so as to (i) retard relative angular motion and retain the launching and handle members at an angle less than the release angle during at least a portion of a swing of the disc launcher, and (ii) enable the launching and handle members to move to the release angle during another portion of the swing.

11. An apparatus for launching a flying disc, the apparatus comprising:

an elongated handle member;

an elongated launching member connected at a proximal end thereof to a distal end of the handle member so as to permit relative angular motion of the launching member and the handle member;

a disc gripper connected to the launching member at a distal end of the launching member; and a release mechanism operatively coupled to the disc gripper and arranged so as to (i) enable the disc gripper to hold the flying disc with the launching and handle members forming an angle less than a release angle and (ii) cause the disc gripper to release automatically the held flying disc as the launching and handle members move to the release angle from an angle less than the release angle, wherein the launching and handle members comprise a single elongated flexible resilient member, and bending of the resilient member provides the relative angular motion.

12. A method for launching a flying disc, the method comprising:

arranging an elongated handle member and an elongated launching member of a disc-launching apparatus to form an angle less than a release angle, the handle member being connected at a distal end thereof to a proximal end of the launching member so as to permit relative angular motion of the launching member and the handle member;

loading the flying disc into a disc gripper, the disc gripper being connected to the launching member at a distal end of the launching member;

engaging a release mechanism operatively coupled to the disc gripper so as to engage the disc gripper to hold the flying disc while the launching and handle members form an angle less than the release angle, the release mechanism being arranged so as to cause the disc gripper to release automatically the held flying disc as the launching and handle members move to the release angle from an angle less than the release angle; and grasping the proximal end of the handle member and swinging the launching apparatus to cause the launching and handle members to move to the release angle and to cause automatically the disc gripper to release the flying disc, thereby launching the flying disc, wherein:

the disc gripper comprises a pair of opposed gripping members arranged for gripping the flying disc positioned between them;

at least one of the opposed gripping members is pivotably connected to the launching member so as to enable relative movement of the gripping members away from and toward one another; and the release mechanism is operatively coupled to at least one of the opposed gripping members so as to (i) bias the opposed gripping members toward one another to hold the flying disc between them with the launching and handle members forming an angle less than the release angle and (ii) release automatically the bias on the gripping members to thereby release the held flying disc as the launching and handle members move to the release angle from an angle less than the release angle.

13. The method of claim 12 wherein one of the opposed gripping members is curved so as to enable engagement with the inner circumferential surface of the lip of the flying disc held between the opposed gripping members.

14. The method of claim 12 wherein each of the gripping members includes a resilient material or a friction material positioned so as to make contact with the held flying disc.

15. The method of claim 12 wherein the launching member and the handle member are arranged to enable the relative angular motion about only a single rotation axis, the gripping members are arranged so that the rotation axis of the relative angular motion is substantially parallel to the axis of the held flying disc, and the swinging of the disc launcher is in a plane substantially perpendicular to the rotation axis.

16. The method of claim 12 wherein the pivotably connected gripping member comprises an elongated lever having a distal lever arm arranged for gripping the flying disc, having a proximal lever arm arranged for engaging the release mechanism, and being pivotably connected to the launching member at a pivot point between the lever arms.

17. The method of claim 16 wherein the proximal lever arm includes a linear ratchet arranged so as to (i) engage the release mechanism to bias the gripping members toward one another with the launching and handle members forming an angle less than the release angle and (ii) disengage automatically from the release mechanism and release the bias on the gripping members as the launching and handle members move to the release angle from an angle less than the release angle.

18. The method of claim 17 wherein the release mechanism comprises a flange on the launching member and a cam portion on the handle member, the flange being arranged so as to engage the linear ratchet, the cam portion being arranged so as to (i) enable engagement of the linear ratchet and the flange with the launching and handle members forming an angle less than the release angle and (ii) force automatic disengagement of the linear ratchet from the flange as the launching and handle members move to the release angle from an angle less than the release angle.

19. The method of claim 12 wherein the launching and handle members are arranged so as to limit the relative angular motion to less than a maximum angle formed between the launching and handle members.

20. The method of claim 12 further comprising adjusting the release angle, adjusting the length of the handle member, adjusting the length of the launching member, or interchanging different disc grippers each adapted hold a different type of flying disc.

21. The method of claim 12 wherein a detent mechanism (i) retards relative angular motion and retains the launching and handle members at an angle less than the release angle during a backswing portion of the swinging of the disc launcher, and (ii) enables the launching and handle members to move to the release angle during a forward portion of the swinging of the disc launcher.

22. A method for launching a flying disc, the method comprising:

arranging an elongated handle member and an elongated launching member of a disc-launching apparatus to form an angle less than a release angle, the handle member being connected at a distal end thereof to a proximal end of the launching member so as to permit relative angular motion of the launching member and the handle member;

loading the flying disc into a disc gripper, the disc gripper being connected to the launching member at a distal end of the launching member;

engaging a release mechanism operatively coupled to the disc gripper so as to engage the disc gripper to hold the flying disc while the launching and handle members form an angle less than the release angle, the release mechanism being arranged so as to cause the disc gripper to release automatically the held flying disc as the launching and handle members move to the release angle from an angle less than the release angle; and grasping the proximal end of the handle member and swinging the launching apparatus to cause the launching and handle members to move to the release angle and to cause automatically the disc gripper to release the flying disc, thereby launching the flying disc, wherein the launching and handle members comprise a single elongated flexible resilient member, and bending of the resilient member provides the relative angular motion.

* * * * *